US008931638B2

(12) United States Patent
Weissbrod

(10) Patent No.: US 8,931,638 B2
(45) Date of Patent: Jan. 13, 2015

(54) SYSTEM FOR PACKAGING A COILED PRODUCT

(71) Applicant: Lincoln Global, Inc., City of Industry, CA (US)

(72) Inventor: Paul A. Weissbrod, South Euclid, OH (US)

(73) Assignee: Lincoln Global, Inc., City of Industry, CA (US)

( * ) Notice: Subject to any disclaimer, the term of this patent is extended or adjusted under 35 U.S.C. 154(b) by 64 days.

(21) Appl. No.: 13/804,157

(22) Filed: Mar. 14, 2013

(65) Prior Publication Data

US 2014/0262890 A1 Sep. 18, 2014

(51) Int. Cl.

| | |
|---|---|
| ***B65D 85/00*** | (2006.01) |
| ***B65H 55/00*** | (2006.01) |
| ***B65D 25/20*** | (2006.01) |
| ***B65B 25/24*** | (2006.01) |

(52) U.S. Cl.

CPC ..... *B65D 25/20* (2013.01); *B65B 25/24* (2013.01)

USPC ..... 206/408; 242/172; 206/397

(58) Field of Classification Search

USPC ..... 206/389–416; 242/129, 137, 1, 242/170–172, 137.1

See application file for complete search history.

(56) References Cited

U.S. PATENT DOCUMENTS

| | | | | | |
|---|---|---|---|---|---|
| 1,945,931 | A * | 2/1934 | Boyle | ..... | 248/448 |
| 4,122,949 | A * | 10/1978 | Blatt | ..... | 206/397 |
| 4,130,961 | A * | 12/1978 | Snow | ..... | 294/66.1 |
| 5,078,269 | A * | 1/1992 | Dekko et al. | ..... | 206/397 |
| 5,105,943 | A * | 4/1992 | Lesko et al. | ..... | 206/397 |
| 5,819,934 | A * | 10/1998 | Cooper | ..... | 206/397 |
| 7,172,070 | B2 * | 2/2007 | Coon et al. | ..... | 206/397 |
| 7,377,388 | B2 * | 5/2008 | Hsu et al. | ..... | 206/408 |
| 7,748,530 | B2 * | 7/2010 | Hsu et al. | ..... | 206/408 |
| 8,534,581 | B2 * | 9/2013 | Cooper et al. | ..... | 242/172 |

* cited by examiner

*Primary Examiner* — Bryon Gehman
(74) *Attorney, Agent, or Firm* — Hahn Loeser & Parks LLP

(57) ABSTRACT

A system for packaging a product stored in a coil having an interior surface that defines a bore, the system including a container having a base and a wall extending upward from the base, the wall defining a space for receiving the coil; a pad supported on the base of the container, the pad including an outer portion that underlies the coil and a plurality of tabs extending inward from the outer portion, wherein the tabs on the pad are circumferentially spaced and define pad notches therebetween; a drum core having a first end and a second end, the drum core being insertable within the bore of the coil, the first end of the drum core having a plurality of tabs extending axially outward therefrom, the plurality of tabs being circumferentially spaced from each other to define notches therebetween, wherein upon insertion, the tabs on the first end of the drum core are received within pad notches and the tabs on the pad extend radially inward into the notches defined by the tabs on the drum core.

32 Claims, 5 Drawing Sheets

SYSTEM FOR PACKAGING A COILED PRODUCT

TECHNICAL FIELD

The present invention pertains to a system for packaging a coiled product including a drum core and a hold-down rod. More particularly, the present invention relates to a drum core that includes a tubular core that defines an interior bore and has a castellated lower surface, and an extendable hold-down rod having a collapsed configuration that has a lateral dimension less than the width of the bore.

SUMMARY OF THE INVENTION

The present invention generally provides a system for packaging a product stored in a coil having an interior surface that defines a bore, the system including a container having a base and a wall extending upward from the base, the wall defining a space for receiving the coil; a pad supported on the base of the container, the pad including an outer portion that underlies the coil and a plurality of tabs extending inward from the outer portion, wherein the tabs on the pad are circumferentially spaced and define pad notches therebetween; a drum core having a first end and a second end, drum core being insertable within the bore of the coil, the first end of the drum core having a plurality of tabs extending axially outward therefrom, the plurality of tabs being circumferentially spaced from each other to define notches therebetween, wherein upon insertion, the tabs on the first end of the drum core are received within pad notches and the tabs on the pad extend radially inward into the notches defined by the tabs on the drum core.

The present invention further provides a method of assembling a system for packaging a product in a coil having an interior surface that defines a bore, the method including providing a container having a base and an upstanding wall defining a space for receiving the coil; placing a pad on the base, the pad including an outer portion having plural pad tabs extending radially inward therefrom, the pad tabs being spaced from each other to form tab notches therebetween; providing the coil within the container and on the pad, where the coil overlies the outer portion of the pad and the pad tabs extend radially inwardly of the interior surface of the coil beneath the coil; providing a drum core formed from a single wall having opposing edges, the drum core having a first end, the first end having plural tabs extending axially outward therefrom, the tabs being spaced from each to define notches therebetween; inserting the drum core within the bore of the coil with the first end of the drum core extending toward the base of the container aligning the drum core with the pad such that the pad tabs extend radially into the notches between the tabs on the drum core and the tabs on the drum core extend axially into the pad notches.

DETAILED DESCRIPTION OF THE INVENTION

Figure 1:
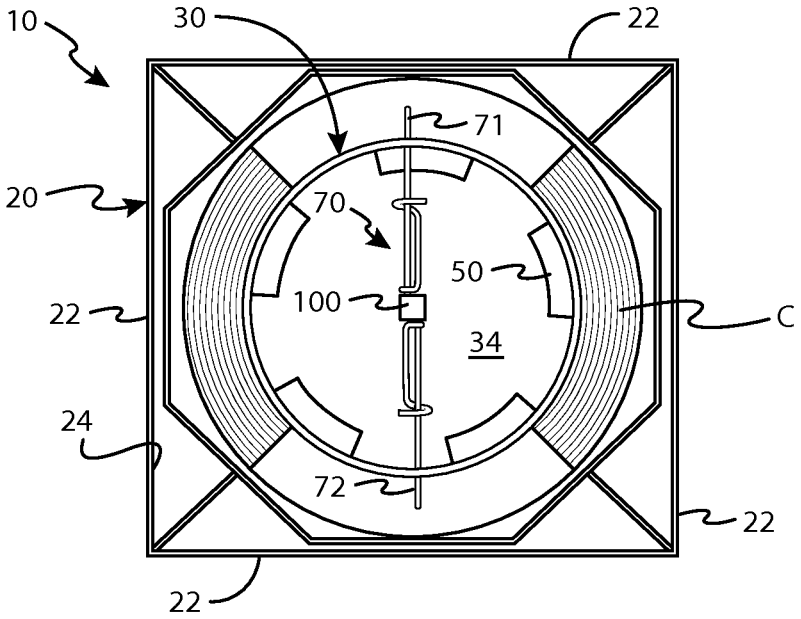
FIG. 1 is a top plan view of a system for packaging a coiled product according to the invention.

Referring now to the drawings for purposes of illustrating embodiments of the invention only and not for purposes of limiting the same, a system for packaging a coiled product according to the invention is generally indicated by the number 10. FIG. 1 shows a container that may be used to retain contiguously formed material, such as for example wire, tube, conduit, cable, line, rope, or string of various types, in a wound or coiled configuration. In one embodiment, the contiguously formed material may be welding wire. In one embodiment, the wire is wound to form a coil C having a generally cylindrical configuration, where the interior surface I formed by coil C defines a bore B.

Figure 9:
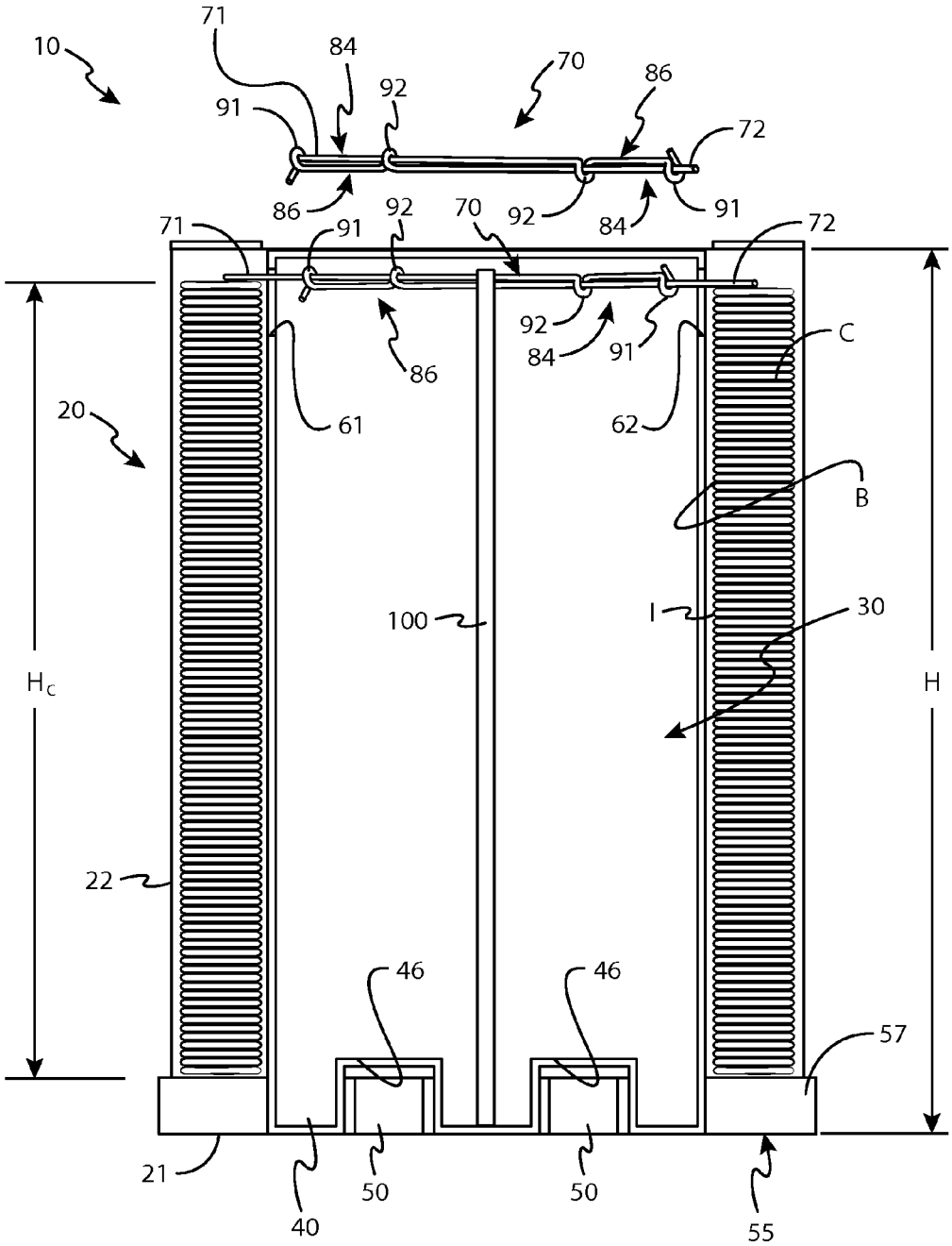
FIG. 9 is a sectioned side elevational view of a system for packaging a coil similar to FIG. 8 showing installation of a hold down rod assembly according to the invention.

With continued reference to FIG. 1 and now to FIG. 9, the system 10 may include a container 20 having a base 21 with one or more sidewalls 22 extending upwardly therefrom. In the example shown, container 20 includes four sidewalls 22 forming a generally square interior 24 in which material is received in a coiled configuration. In the example shown, container 20 further includes corner pieces 26 that extend at an angle between adjacent sidewalls 22 to more closely conform to coil C by providing the interior 24 with a generally octagonal configuration. In the example shown, coil C is formed within the interior 24 of container 20 or otherwise loaded into container 20.

A drum core, generally indicated by the number 30, is inserted within bore B of coil C to help maintain the orientation of coil C during transport or handling. As shown, drum core 30 may include a one or more walls 32 and may be solid or hollow. In the example shown, drum core 30 includes a single wall 32 that is placed in a tubular configuration to define a hollow center 34. Wall 32 may be formed into a hollow cylinder having a diameter that is sized to fit closely to the interior surface I formed by coil C. Alternatively, as shown, wall 32 may be bent into a cylindrical configuration and its edges 33 left un-joined so that the wall 32 may be compressed to a smaller diameter cylindrical configuration when inserting the wall 32 into bore B and released to allow the wall 32 to expand to contact and conform to the interior surface I of coil C, as described more completely below. Other configurations of drum core 30 may be chosen without limiting the intended scope of coverage of the embodiments of the subject invention. For example, drum core 30 may be constructed of one or more members and have any shaped cross-section including but not limited to the cylindrical shape shown, other polygonal shapes including solid and tubular configurations.

The outer diameter D of the core drum 30 may vary with the type and length of material held by container 10 and the diameter of bore B formed by this material. It will be understood that in forming a coil C, the interior surface I is not always consistent and material may be coiled in a fashion that causes portions of coil C to protrude inward more than others. The diameter of bore B is thus considered to be an effective diameter created by the coil C and generally corresponds to the smallest diameter formed by the material in coil C. Outer diameter D of drum core 30 is less than the diameter of the bore B to facilitate it insertion within coil C. For example, in a welding wire coil application, the outer diameter D may be in the range of 12 to 20 inches. The drum core has a height H, which also may vary with the type and length of material held by container 10 and the resulting height Hc of coil C. In general, height H of drum core 30 is greater than or equal to the height Hc of coil C. In the example shown, height H of drum core 30 is greater than height Hc to facilitate insertion of a hold-down rod through drum core 30 as discussed more completely below.

The drum core 30 may be constructed of any material of sufficient strength to maintain the coil C and resist compressive forces from coil C caused by shifting of the coil C during transport or other handling. To that end, drum core 30 may be made of paper products including cardboard or craft paper, wood including wood composite materials, plastics or other polymer or rubber based materials, fiber reinforced resin materials, metals, or combinations thereof. It is anticipated that coil C may have some irregularity in its interior surface I resulting from the winding technique used to form the coil C or the material being wound in the coil C. To that end, drum core 30 may be constructed of a flexible material that will accommodate these irregularities. In other instances, it may be desirable to provide a drum core that has an internal resiliency that biases the wall of drum core 30 outward to engage the interior surface I of coil C. In the example shown, the drum core 30 is made of a corrugated paper.

Figure 2:
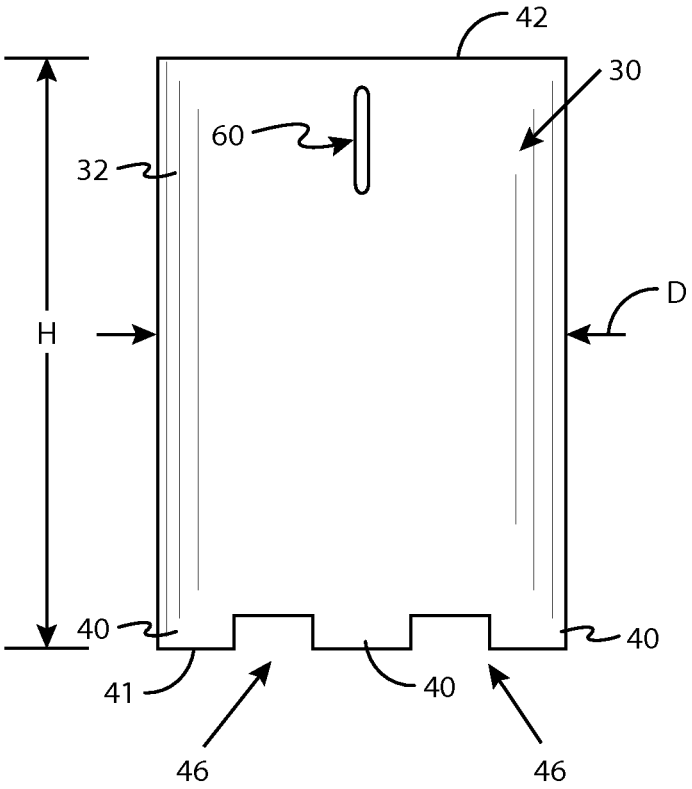
FIG. 2 is left side view of a drum core according to the invention.
Figure 3:
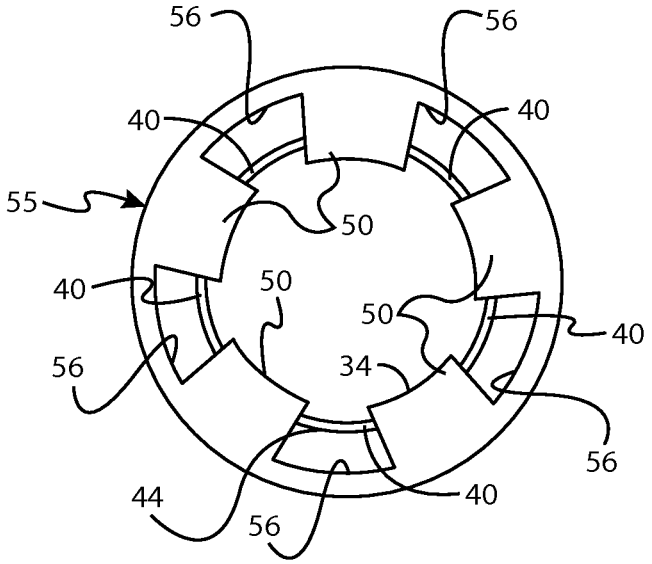
FIG. 3 is a top plan view of a drum core and a pad according to the invention.

With reference to FIG. 2, drum core 30 may have tabs 40 extending axially outward from at least one end thereof. In the example shown, tabs 40 extend outward from a first end 41 of drum core 30 and second end 42 of drum core 30 does not have tabs. As shown, tabs 40 may be spaced about the perimeter 44 of drum core 30 defining recesses or notches 46 therebetween. The tabs 40 may be substantially square or rectangular in profile but other embodiments are contemplated where the tabs 40 may be any other suitable shaped profile. The tabs 40 may be formed on first end 41 of drum core 30 by removal of the drum core material from drum core 30 to form a substantially concave indentation or notch 46 bounded on a first side by one tab 40 and on a second side by an adjacent tab 40. In the example shown, drum core 30 is a hollow cylinder causing the notch 46 to be formed within a relatively thin wall of drum core 30. If a solid drum core 30 or wall having a greater thickness is used, it will be appreciated that the thickness of notch may be equal to or less than the thickness of drum core 30. In the example shown, notches 46 overlie and receive radially inward extending tabs 50 formed on a base pad 55, as described more completely below. When a solid drum core 30 or drum core having a thickness greater than tabs 50 on pad 55 are used, to allow the drum core 30 to seat properly within container 10, notches 46 must have sufficient circumferential dimension or width sufficient to receive tabs 50. To that end, tabs 40 are circumferentially spaced by notches 46 having a width at least equal to the width of a tab 50. In the example shown, drum core 30 is formed from a single wall 32 that is bent to form a cylinder. The edges 33 of wall 32 may be drawn together to form a cylinder having a diameter smaller than bore B of coil C to facilitate its insertion. After drum core 30 is inserted and the compressive force released, the resiliency of the wall 32 allows the drum core 30 to expand to conform to the interior surface I of coil C. As best seen in FIG. 3, the edges 33 may still overlap in the expanded configuration. To allow for movement of wall 32 from the compressed configuration to the expanded configuration, notches 46 may be made wider than tabs 50 on pad 55. In this way, wall 32 of drum core 30 is allowed to move circumferentially from the compressed configuration to the expanded configuration even when tabs 50 are within notches 46 by the clearance provided by the wider notches 46.

Once the wall 32 is in the expanded configuration and properly positioned within the bore B of coil C, the edges 33 may be attached to each other with a suitable fastener including but not limited to an adhesive, a weld, a clip, a rivet, a staple or the like. In the example shown, edges 33 are attached with a hot glue gun after the drum core 30 is installed.

Figure 4:
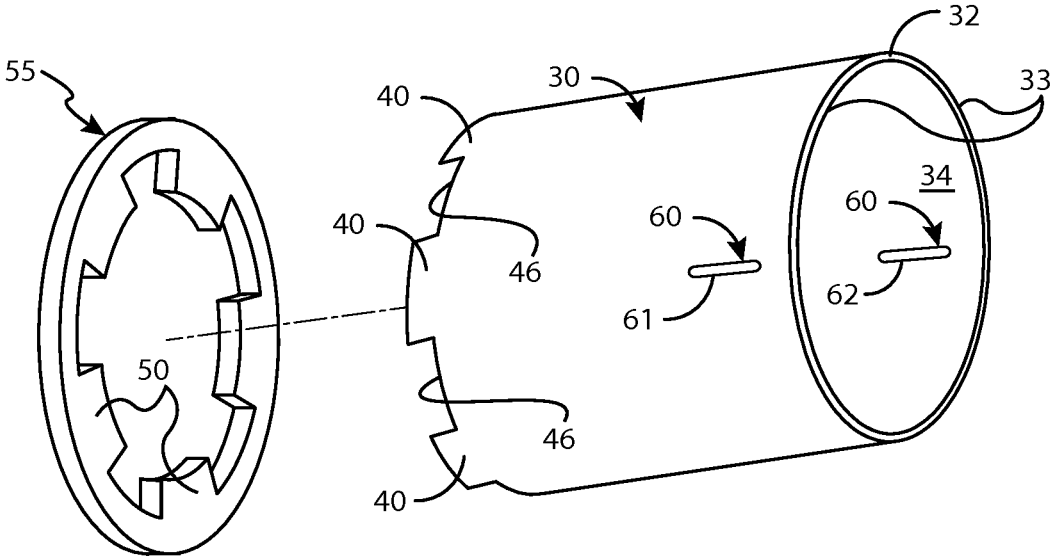
FIG. 4 is an exploded perspective view of a drum core, pad, and hold down rod assembly according to the invention.

With continued reference to FIGS. 2-4, the tabs 40 may have a tab thickness defined by the outer surface of the drum core 30 and the inner surface of drum core 30. The tab 40 may also have a circumferential dimension or tab width and an axial dimension or tab height. Likewise, when considering pad 55, pad 55 includes tabs 50 spaced about the circumference of pad 55 and extending radially inward at positions corresponding to the notches formed between tabs 40. Tabs 50 define pad notches 56 that receive tabs 40.

The tab height may be less than or equal to the height of pad notch 56 so that tab 40 is completely received within pad notch 56 and presents no visible gap. The height of tab 40 may be greater than the height of pad notch 56, however, it is expected that this would create gaps between tabs 40 above pad 55.

In one embodiment, the tabs 40 may be spaced uniformly around the circumference of one end of drum core 30 although other embodiments are contemplated where the spacing between tabs 40 varies. The number, width, and spacing of the tabs 40 may depend upon the size of the drum core 30 and the diameter of the wire or other material coiled about drum core 30.

In one embodiment, a first end 41 of drum core 30 may be castellated to form a series of equally spaced tabs 40 and sized to be received by corresponding pad notches 50 formed within pad 55. While the tabs 40,50 may be substantially square or rectangular in shape, those of ordinary skill in the art will understand that drum core and pad notches 46,56 may be cut using a die with a slightly dovetailed profile of about 3 degrees to 5 degrees.

With continued reference to FIGS. 1-4, system 10 may be assembled such that the pad 55 is placed on the base of container 20 and coil C is formed over and rests on pad 55. In the example shown, an outer portion 57 of pad 55 underlies a portion of coil C while tabs 50 extend inward and lie within area circumscribed by the bore B of coil C. Drum core 30 is inserted within bore B with first end 41 being inserted first such that tabs 40 formed on first 40 are placed within notches 56 between tabs 50 of pad 55. As best shown in FIG. 3, tabs 50 on pad 55 may extend radially inward beyond wall 32 of drum core 30 and into the hollow interior 34. The interlocking relationship of tabs 40,50 on drum core 30 and pad 55 respectively reduces the likelihood that the product being coiled will slip under drum core 30. In addition, the interengagement between drum core 30 and pad 55 is believed to provide more stability to drum core 30 facilitating its function of maintaining the orientation of coil C during shipment or handling.

According to another aspect of the invention, drum core 30 may be provided with slots, generally indicated at 60, to receive a hold down rod that further acts to maintain the orientation of the coil C by restricting axial movement of coil C. Any number of slots 60 may be provided at diametrically opposed positions to allow a hold down rod to be inserted and extend outward of drum core 30 to engage a portion of coil C. In the example shown, two slots 60 are provided on opposite sides of drum core 30. In some instances, loose material such as glass beads or marbles, which may be referred to as "gems"

are placed on the upper surface of coil C. In such applications, to prevent gems from falling into bore B or becoming lodged in slot 60 may be narrower than a typical gem. For example, a slot 60 having a width less than 0.500 inches is suitable. In the example shown, slot 60 has a width of about 0.250 inches.

Figure 8:
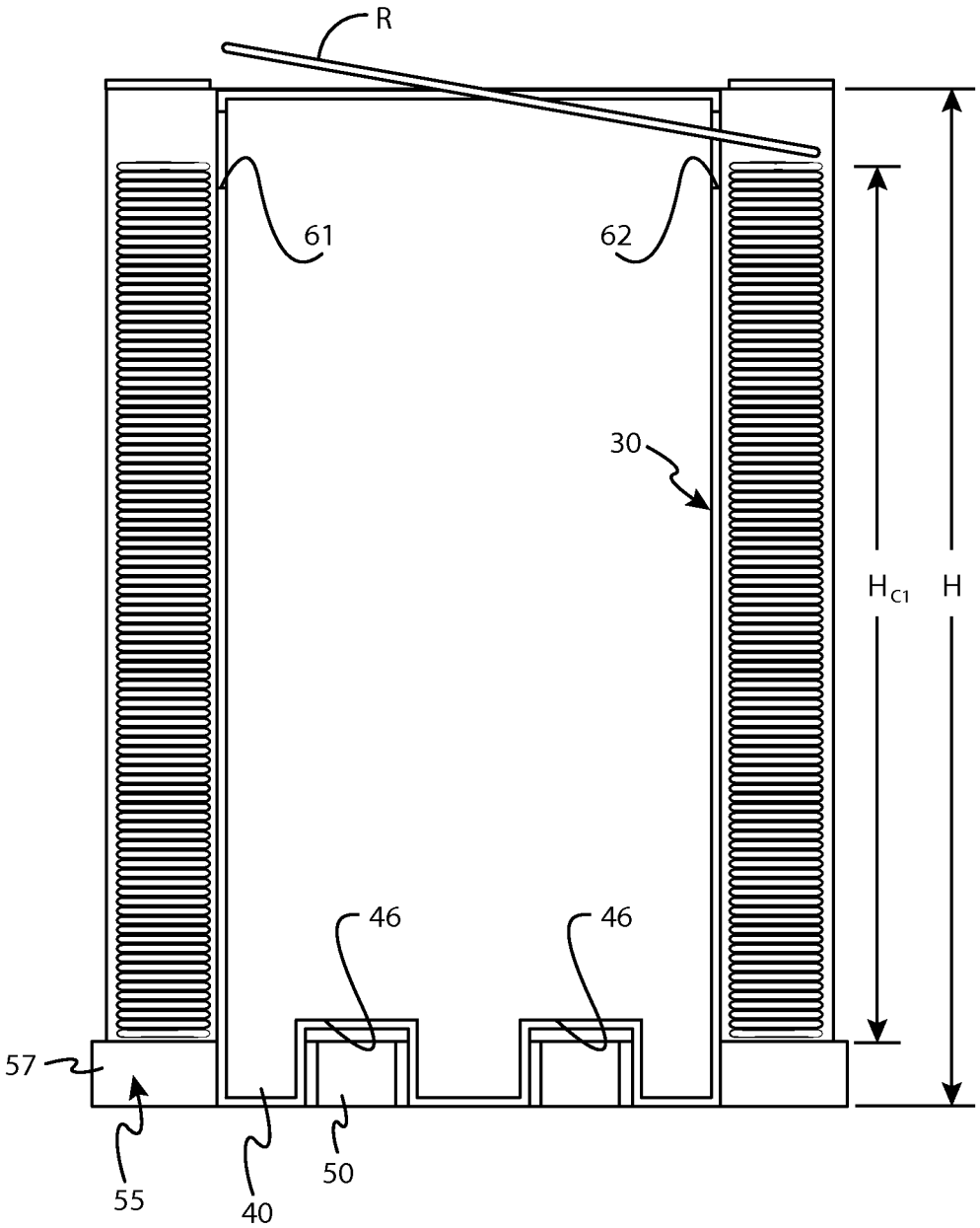
FIG. 8 is a sectioned side elevational view of a system for packaging a coil showing installation of a prior art hold down rod.

As best shown in FIG. 8, a conventional hold down rod is a straight solid rod having a first end that is inserted through a first slot 61 until the second end of hold down rod lies within the interior 34 of drum core 30 so that it may be inserted through second slot 62. The conventional hold down rod is then slid into a position where first and second ends of the rod each overlie a portion of the coil C. As shown in FIG. 8, because the conventional rod must be inserted at an angle, the first end of this rod must extend below the slot requiring additional clearance beneath the slots 60 for coil C. As a result, the height of coil C is limited to a position beneath slots 60 to provide sufficient clearance for rod.

In accordance with another aspect of the invention, a hold down rod assembly, generally indicated by the number 70 is provided. Hold down rods are used in systems for packaging products in a coiled configuration to provide a downward force i.e. toward the base of the container 20, to help hold the coil in place. A prior art hold down rod R is shown in FIG. 8. Hold down rods currently used are thin rod having a constant diameter and a length greater than the diameter of bore B so that the ends of the rod R overlie a portion of the coil, when the rod is arranged horizontally. A tether or other restraint is attached to the base of the container and stretched over hold down rod to apply a compressive force to the coil through the rod. As shown in FIG. 8, when a drum core, as described above is used, one end of the rod R must be angled downward through the slot 62 in the drum core 30 to position the opposite end of the rod within the drum core and align it with the opposite slot. As a result, the height of the coil $H_{c1}$ is limited to an area below the slot to provide clearance for the downward angle of the rod.

Figure 5:
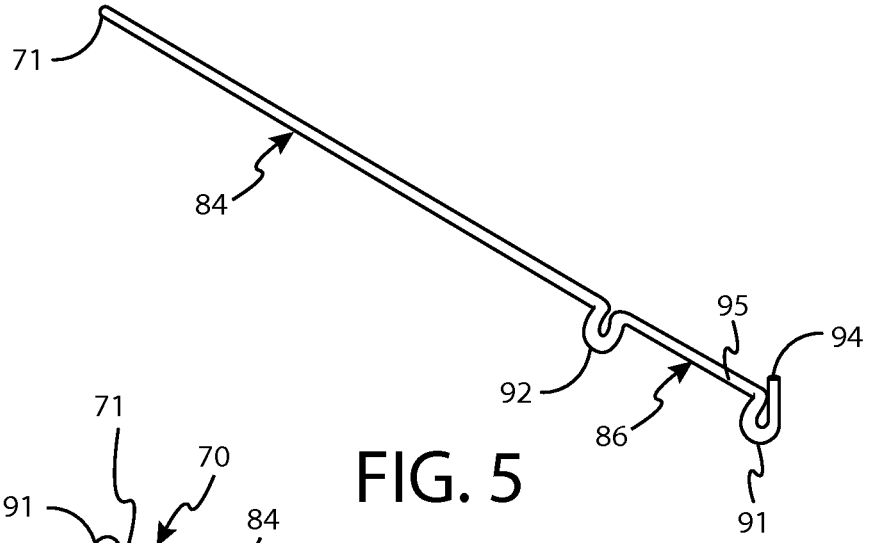
FIG. 5 is a perspective view of a rod according to the invention.
Figure 6:
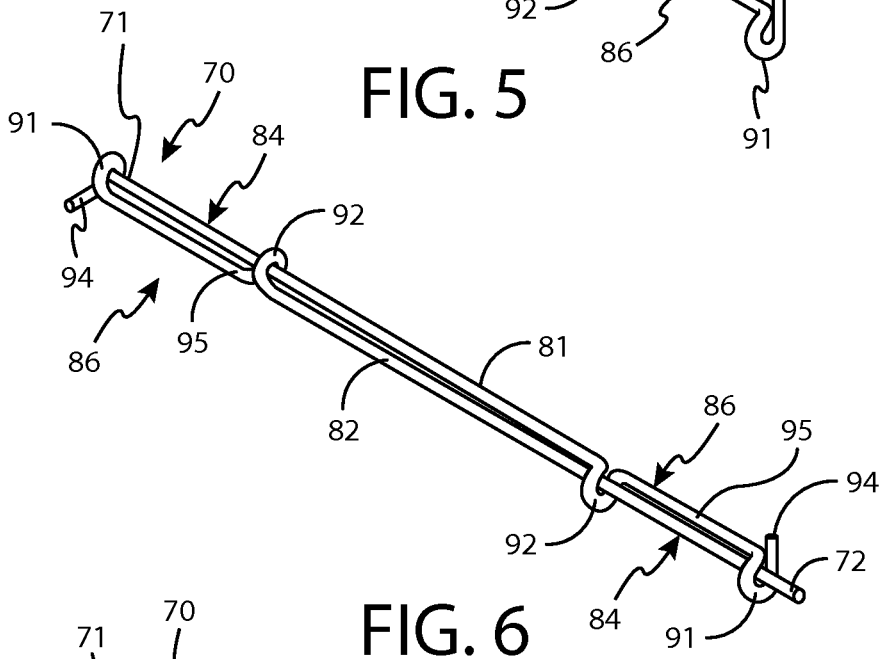
FIG. 6 is a perspective view of a hold down rod assembly according to the invention in a collapsed configuration.
Figure 7:
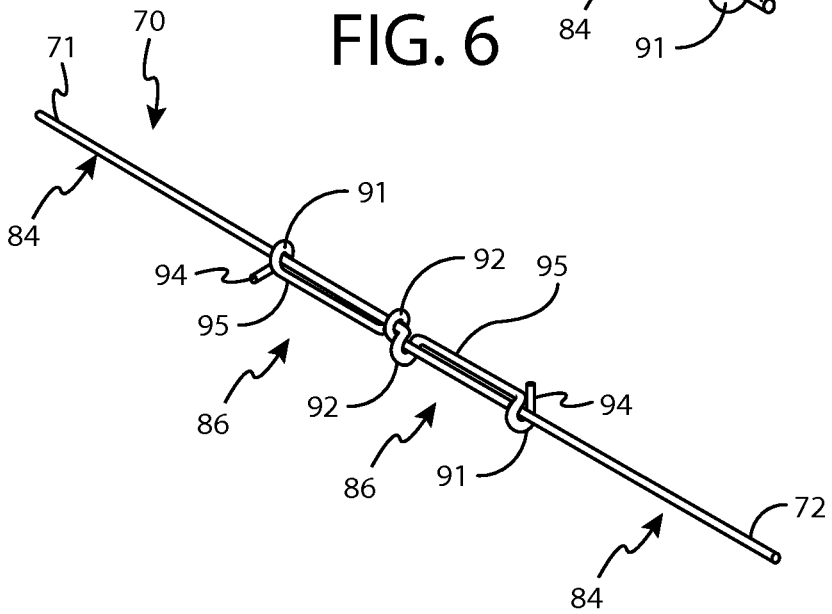
FIG. 7 is a perspective view similar to FIG. 6 showing the rod assembly in an extended configuration.

In accordance with another aspect of the invention, hold down rod assembly 70 is collapsible. As best shown in FIGS. 5-7, collapsible rod assembly 70 includes a first end 71 and a second end 72 that have an expanded configuration where the ends are spaced a distance greater than the diameter of drum core 30 and/or bore B allowing each end 71,72 to overlie a portion of coil C when inserted through respective slots 61,62. From the expanded position, one or more of ends 71, 72 are movable inward to reduce the effective lateral dimension of rod assembly 70 to clear the interior of drum core 30 when the opposite end is inserted within one of the slots 61,62.

For example, collapsible assembly 70 may include a tube having a hollow center with a one or more rods partially supported within the tube. The rod and tube may be moved relative to each other to extend or retract the lateral dimension of the overall assembly as discussed above. A variation would include a central rod or tube having two tubes or rods supported on either end, where the two outer members are moved inward to collapse the rod assembly our outward to extend the rod assembly.

According to another embodiment, shown in FIGS. 5-7 and 9, rod assembly 70 includes a first rod 81 and a second rod 82, where first end 71 is located on first rod and second end 72 is located on second rod 82. In the example shown, first and second rods 81,82 have the same shape and are arranged together in a symmetrical fashion. It will be appreciated that rods 81,82 do not have to have the same shape or a symmetrical arrangement. In the example shown, each rod 81,82 has a an outer section 84 and an attachment section 86. The outer section 84 is received in a slot 60 within drum core 30 and may be formed as a straight section of rod-like material. In the example shown, this section includes a rod having a circular cross section. It will be appreciated that other shapes and cross-sections may be used. The end 71,72 of outer section 84 is configured to be inserted through slot 60 and overlie a portion of coil C. In the example shown, each end 71, 72 has a diameter of about 0.250 inches.

Attachment section 86 includes an assembly that connects first rod 81 to second rod 82. The attachment permits movement of rods 81, 82 between a collapsed configuration and an expanded configuration as described above. In the example shown, attachment section 86 includes a first loop 91 and a second loop 92. First loop 91 is formed at an end of each rod 81,82 opposite ends 71,72. The second loop 92 is optional and is spaced inward of the first loop 91 to provide a second point of support for each rod 81,82 and act as a stop when placing the rod assembly in the expanded configuration (FIG. 7).

First and second loops 91, 92 may be formed in any manner including simply attaching preformed loops to each rod 81,82 as by a weld or other suitable fastener. In the example shown, first and second loops 91,92 are formed integrally with each rod 81,82 by bending the rod. As shown, when bending first loop 91 the end of the rod may extend outward of the diameter of loop 91 to form a tab 94 which facilitates the bending process and also may be used to move the rods 81,82 relative to each other when assembled. In forming first loop 91, tab 94 may extend through axis A of outer section 84 and beyond axis A before turning radially outward from axis A. The bend of loop 91 may continue in a semi-circular fashion to return to axis A, where the rod is bent outward from first loop 91 to form spacer section 95, which as shown lies along axis A. In this manner, the center axis of loop 91 offset from axis A.

The second loop 92 is also formed in the exemplary rod by bending and may be spaced inward from first loop 91 by a spacer section 95 of rod. As shown, spacer section 95 may extend along the same axis A as outer section 84. Second loop 92 may be formed in the same general configuration as first loop 91 with the exception that a tab 94 is not formed. In the example shown, second loop 92 is formed by bending the rod downward from spacer section 95 and radially outward to form a semi-circular portion that bends upward to the level of axis A, where it joins outer section 84.

Second loop 92, like first loop 91 is offset from the axis A. The loops 91, 92 may be formed along the same offset axis receive a straight outer section 84 of a second rod therethrough. In the example shown, the axis extending through loops 91,92 is offset and parallel to axis A of outer section 84.

FIG. 6 shows a pair of rods 81,82 assembled together to form a rod assembly 70, and arranged in a collapsed configuration i.e. where the rod assembly 70 has its shortest lateral dimension. In this configuration, elongate sections 84 are retracted such that first end 71 lies in first loop 91 of second rod 82 and second end 72 lies in first loop 91 of first rod 81. To extend rod assembly 70, ends 71,72 are driven outward by bring second loops 92 of each rod 81,82 toward each other. Second loops 92 contact each other in the fully extended position shown in FIG. 7. It will be appreciated that the dimensions of the components of rod assembly 70 may vary depending upon the application for which the assembly 70 is used, and the following example should not be considered limiting. Rod assembly 70, shown, has a lateral dimension of about 15 inches in the collapsed configuration (FIG. 6). This allows rod assembly 70 to fit with the bore B of a typical wire coil without contacting drum core 30 (FIG. 9). Ends 71,72 of rod assembly 70 may be aligned with slots 60 above the coil height $H_{c2}$ and then extended to by sliding first rod 81 and second rod 82 outward relative to each other to insert ends 71,72 in the respective slots 60 and overlap a portion of coil C. In the example shown, the overall lateral dimension of rod assembly 70 in the expanded configuration (FIG. 7) is about 21 inches.

As best illustrated through a comparison of FIGS. 8 and 9, allowing the ends 71,72 to be aligned with slots 60 at a height above the coil C allows insertion of rod assembly 70 without any significant angle that would require additional clearance on the coil side of slot 60. In this way significantly greater material may be placed in coil C by filling container near to the top of slot 60. As seen in comparing FIGS. 8 and 9, coil height $H_{c2}$ (FIG. 9) is greater than coil height $H_{c1}$ (FIG. 8).

According to another aspect of the invention, a method of inserting a hold down rod assembly 70 includes the steps of placing rod assembly in a collapsed configuration where opposite ends 71,72 of rod assembly have a lateral dimension less than a diameter of drum core 30 or bore B of coil C. Inserting the collapsed rod assembly within the drum core 30 and aligning the ends 71,72 with respective slots 60. As an option, an elastic band or other restraint 100 extending upward from the base of container may be slipped over an end 71 or 72 of rod assembly 70 before expanding the rod assembly 70. It will be appreciated that the restraint typically applies tension to hold down rod assembly 70. Therefore, when attaching restraint to hold down assembly 70 before insertion, it may be necessary to stretch the restraint to properly position the ends 71,72 or temporarily release the tension created by the restraint while positioning the ends 71,72 within slots 60.

Once ends 71, 72 are aligned with slots 60 over the height Hc of coil C, rod assembly 70 may be extended. Rod assembly 70 is extended by moving ends 71, 72 outward relative to each other and through slots 60 to overlie a portion of coil C. With respect to the particular embodiment shown, expansion of rod assembly 70 is effected by sliding outer sections 84 outward through first loop 91 until second loops 92 on rods 81,82 come into contact with each other. If a restraint was not attached earlier, it can be attached to hold down rod assembly 70 when it is in the expanded position to apply a downward force on rod assembly 70 and hold ends 71,72 against coil C. To protect the material in coil C, end pads may be inserted between the ends 71,72 of rod assembly 70 and coil C.

In the embodiment shown, in the extended configuration, relatively thin ends 71,72 extend outward for insertion through slots 60 allowing the slots 60 to have a narrow opening. The overlapping portion of rod assembly 70 formed by the loops 91,92 and spacer sections 95 of rods 81,82 are located generally in the center of rod assembly where the force of the hold down restraint 100 is applied. This force may cause some deflection across the lateral dimension of rod assembly 70 which prevents further relative movement of ends 71,72.

The invention has been described herein with reference to the preferred embodiment. Obviously, modifications and alterations will occur to others upon a reading and understanding of this specification. It is intended to include all such modifications and alternations in so far as they come within the scope of the appended claims or the equivalence thereof.

The invention claimed is:

1. A system for packaging a product stored in a coil having an interior surface that defines a bore, the system comprising:

a container having a base and a wall extending upward from the base, the wall defining a space for receiving the coil;

a pad supported on the base of the container, the pad including an outer portion that underlies the coil and a plurality of tabs extending inward from the outer portion, wherein the tabs on the pad are circumferentially spaced and define pad notches therebetween;

a drum core having a first end and a second end, the drum core being insertable within the bore of the coil, the first end of the drum core having a plurality of tabs extending axially outward therefrom, the plurality of tabs being circumferentially spaced from each other to define notches therebetween, wherein upon insertion, the tabs on the first end of the drum core are received within the pad notches and the tabs on the pad extend radially inward into the notches defined by the tabs on the drum core.

2. The system of claim 1, wherein the notches defined by the tabs on the drum core are wider than the tabs on the pad.

3. The system of claim 1, wherein the drum core includes a wall defining a hollow interior, and wherein the tabs on the pad extend radially inward of the wall through the notches defined by the tabs on the first end of the drum core.

4. The system of claim 1, wherein the drum core is constructed of a resilient material and is compressible to a compressed configuration having a lateral dimension smaller than the interior surface of the coil, and expandable from the compressed configuration to an expanded configuration placing the drum core in contact with the interior surface of the coil.

5. The system of claim 4, wherein the drum core is formed from a single wall in a cylindrical configuration with opposite edges that overlap each other.

6. The system of claim 5, wherein once the drum core assumes the expanded condition contacting the interior surface of the coil, the overlapping edges are fixed relative to each other with a fastener.

7. The system of claim 6, wherein the fastener is hot glue.

8. The system of claim 1, wherein the tabs on the first end of the coil have a rectangular profile.

9. The system of claim 1, wherein the drum core has a height greater than a height of the coil.

10. The system of claim 9, wherein the drum core includes a wall defining a hollow interior, the wall forming a pair of slots on opposite sides thereof, the slots extending at least partially above the height of the coil, and a hold down assembly insertable through the slots to engage the top of the coil.

11. The system of claim 10, wherein the hold down assembly includes a collapsible rod assembly having a first end and a second end that are selectively moveable toward each other to assume a collapsed configuration where with the first end of the rod assembly inserted through one of the slots, the second end of the rod assembly clears the interior of the drum core and is extendable to an extended position where the first end and second end are moved outward relative to each and inserted through the slots while both ends are located above the coil.

12. The system of claim 11, wherein the rod assembly includes a first rod and a second rod each having a length less than a lateral dimension of the hollow interior of the drum core, each rod including a first loop at one end, a second loop spaced from the first loop and an outer section extending outward from the second loop and defining an axis;

the first loop and the second loop are offset from the axis defined by the outer section;

wherein the outer section of the first rod is received within the first loop and second loop of the second rod and the outer section of the second rod is received within the first loop and second loop of the first rod;

wherein the first end of the rod assembly is formed by the outer section of the first rod and the second end of the rod assembly is formed by the outer section of the second rod;

wherein in the collapsed configuration, the first end of the rod assembly resides within the first loop of the second rod and the second end of the rod assembly resides within the first loop of the second rod; and wherein the outer section of the first rod is slideably received in the first and second loops of the second rod and the outer section of the second rod is slideably received in the first and second loops of the first rod to move the first end and second end away from each other toward the extended position.

13. The system of claim 12, wherein the first end and second end are movable away from each other to assume a fully extended position where the second loop of the first rod and the second loop of the second rod contact each other.

14. The system of claim 12, wherein the loops in each rod are integrally formed by bending the rod.

15. The system of claim 14, wherein each of the first loops includes a tab that extends outward of a diameter thereof.

16. The system of claim 12, wherein the first and second loops on each rod are spaced from each other by a spacer section extending along the axis of the outer section.

17. The system of claim 12 further comprising a restraint attachable to the base of the container and the rod assembly to apply a downward force to the coil.

18. The system of claim 12, wherein each rod has a diameter of about 0.250 inches.

19. The system of claim 12, wherein the lateral dimension of the rod assembly is about 15 inches in the collapsed configuration and about 21 inches in the extended configuration.

20. A method of assembling a system for packaging a product in a coil having an interior surface that defines a bore, the method comprising:

providing a container having a base and an upstanding wall defining a space for receiving the coil;

placing a pad on the base, the pad including an outer portion having plural pad tabs extending radially inward therefrom, the pad tabs being spaced from each other to form tab notches therebetween;

providing the coil within the container and on the pad, where the coil overlies the outer portion of the pad and the pad tabs extend radially inwardly of the interior surface of the coil beneath the coil;

providing a drum core formed from a single wall having opposing edges, the drum core having a first end, the first end having plural tabs extending axially outward therefrom, the tabs being spaced from each to define notches therebetween;

inserting the drum core within the bore of the coil with the first end of the drum core extending toward the base of the container aligning the drum core with the pad such that the pad tabs extend radially into the notches between the tabs on the drum core and the tabs on the drum core extend axially into the pad notches.

21. The method of claim 20, wherein the step of inserting includes compressing the drum core to a diameter smaller than a diameter of the bore of the coil and once the pad tabs are received in the notches releasing the drum core to allow it to contact the interior surface of the coil and fastening the opposing edges of the drum core to each other.

22. The method of claim 20, further comprising cutting a first slot and a second slot in the drum core in diametrically opposed positions on the drum core, where the slots extend at least partially above the coil and providing a hold down rod assembly in a collapsed configuration and inserting the hold down rod assembly within the interior of the drum core, aligning a first end of the hold down rod assembly with the first slot and a second end of the hold down rod assembly with the second slot, expanding the hold down rod assembly by moving the first and the second end outward relative to each other along at least a horizontal plane located above the coil to insert the first end and the second end through the respective first slot and second slot to overlie at least a portion of the coil.

23. The method of claim 22 further comprising attaching a restraint to the base of the container and attaching the restraint to the hold down rod assembly to apply a compressive force to the coil.

24. The method of claim 23, wherein the step of attaching the restraint to the hold down rod assembly includes inserting the one end of the hold down rod assembly through the restraint while the hold down rod assembly is within the drum core in the collapsed condition and before the step of inserting the ends of the hold down rod assembly through the slots.

25. A hold down rod assembly comprising:

a drum core adapted to fit within a coil, the drum core having an interior defining a bore, the drum core having a pair of slots formed therein on opposite sides of the bore, wherein the slots extend at least partially above the coil;

a collapsible rod assembly having a first end and a second end that are selectively moveable toward each other to assume a collapsed configuration where with the first end of the rod assembly can be inserted through one of the slots, the second end of the rod assembly clears the interior of the drum core and is extendable to an extended position where the first end and second end are moved outward relative to each other and inserted through the slots while both ends are located above the coil.

26. The hold down rod assembly of claim 25, wherein the collapsible rod assembly includes a first rod and a second rod each having a length less than a lateral dimension of the drum core, each rod including a first loop at one end, a second loop spaced from the first loop and an outer section extending outward from the second loop, the outer section defining an axis;

the first loop and the second loop are offset from the axis defined by each outer section;

wherein the outer section of the first rod is received within the first loop and second loop of the second rod and the outer section of the second rod is received within the first loop and second loop of the first rod;

wherein the first end of the rod assembly is formed by the outer section of the first rod and the second end of the rod assembly is formed by the outer section of the second rod;

wherein in the collapsed configuration, the first end of the rod assembly resides within the first loop of the second rod and the second end of the rod assembly resides within the first loop of the second rod; and wherein the outer section of each of the first rod and second rod is slideable to move the first end and second end away from each other toward the extended position.

27. The hold down rod assembly of claim 26, wherein the first end and second end are movable away from each other to assume a fully extended position where the second loop of the first rod and the second loop of the first rod contact each other.

28. The hold down rod assembly of claim 26, wherein the loops in each rod are integrally formed by bending the rod.

29. The hold down rod assembly of claim 28, wherein a tab extends outward of a diameter of each of the first loops.

30. The hold down rod assembly of claim 26, wherein the first and second loops on each rod are spaced from each other by a spacer section extending along the axis of the outer section.

31. The hold down rod assembly of claim 26, wherein each rod has a diameter of about 0.250 inches.

32. The hold down rod assembly of claim 26, wherein the lateral dimension of rod assembly is about 15 inches in the collapsed position and about 21 inches in the extended position.

* * * * *